US008083651B2

(12) United States Patent
Lu

(10) Patent No.: US 8,083,651 B2
(45) Date of Patent: Dec. 27, 2011

(54) EXERCISE APPARATUS

(75) Inventor: Tung-Wu Lu, Taipei County (TW)

(73) Assignee: Tung-Wu Lu, Taipei County (TW)

( * ) Notice: Subject to any disclaimer, the term of this patent is extended or adjusted under 35 U.S.C. 154(b) by 0 days.

(21) Appl. No.: 12/731,155

(22) Filed: Mar. 25, 2010

(65) Prior Publication Data

US 2010/0248905 A1 Sep. 30, 2010

(30) Foreign Application Priority Data

Mar. 26, 2009 (TW) ..... 98204814 U

(51) Int. Cl.
*A63B 22/06* (2006.01)

(52) U.S. Cl. ..... 482/57; 482/8; 73/379.07

(58) Field of Classification Search ..... 482/51, 482/52, 57–65, 1–9; 73/379.07
See application file for complete search history.

(56) References Cited

U.S. PATENT DOCUMENTS 4,462,252 A * 7/1984 Smidt et al. ..... 73/379.01
4,641,832 A * 2/1987 Mattox ..... 482/45
4,665,928 A * 5/1987 Linial et al. ..... 600/595
5,137,501 A * 8/1992 Mertesdorf ..... 482/57
5,257,540 A * 11/1993 Bower et al. ..... 73/379.07
5,586,559 A * 12/1996 Stone et al. ..... 600/595
7,481,747 B2 * 1/2009 Lechleiter ..... 482/57
2007/0281834 A1 * 12/2007 Lai ..... 482/57
2007/0298942 A1 * 12/2007 Hamady ..... 482/110
2008/0096729 A1 * 4/2008 Hsu ..... 482/51
2009/0211395 A1 * 8/2009 Mul'e ..... 74/594.7

* cited by examiner

*Primary Examiner* — Stephen Crow

(74) *Attorney, Agent, or Firm* — CKC & Partners Co., Ltd.

(57) ABSTRACT

An exercise machine includes a frame, a saddle, at least one crank arm, at least one pedal, a force measurement, an angle detector, a processor, and an adjustment mechanism. The saddle is connected to the frame. The crank arm is pivotally connected to the frame, and the pedal is pivotally connected to the crank arm. The force measurement measures a force applied to the crank arm, and the angle detector detects a crank arm angle. The processor is programmed to calculating a work value according to the force and the crank arm angle. The feedback mechanism returns the work value to a user.

6 Claims, 4 Drawing Sheets

EXERCISE APPARATUS

RELATED APPLICATIONS

This application claims priority to Taiwan Application Serial Number 98204814, filed Mar. 26, 2009, which is herein incorporated by reference.

BACKGROUND

1. Technical Field

The present disclosure relates to exercise machines.

2. Description of Related Art

Riding a bicycle or exercise bike is one of modern people's favorite sports. The bicycle or the exercise bike has more and more functions for meeting the users' needs. For example, the bicycle has an adjustable saddle or derailleur gears.

When a user rides a bicycle, the condition of the bicycle is adjusted to suit the user's condition. For example, the height of the saddle of the bicycle is adjusted to fit the beginning status of the user. The same as when the user rides an exercise bike or a stationary cycling machine. However, the height of the saddle of the bicycle suits the status of the user at the beginning does not mean that it suits the status of the user during riding the bicycle. Because the physical ability of the user is changed as the user rides the bicycle, the user's posture is changed. Therefore, the condition of the bicycle, such as the saddle position, handle height and the pedal resistance, should suit different user's condition while the user rides the bicycle to prevent user from sports injury.

The condition of the conventional bicycle or the exercise bike is manually adjusted by user when the user feels uncomfortable. When user needs to adjust the condition of the bicycle, the user should stop exercise first. In addition, the condition of the bicycle sometimes is adjusted several times for suiting the user's condition. Furthermore, the risk of sports injury is increased if the condition of the bicycle is manually adjusted improperly.

Exercise is not simply a movement of the body. An effective exercise requires the user's heart rate to rise to a certain level for a period of time. In other words, an effective exercise should have a certain degree of intensity and duration. The degree of intensity and duration can be different for different users, and it depends on each user's physical ability. Many people cannot reach the effective duration under a given intensity due to personal physical condition so that the benefits of sports cannot be obtained.

SUMMARY

According to one embodiment, an exercise machine is provided. The exercise machine includes a frame, a saddle; at least one crank arm, at least one pedal, a force measurement, an angle detector, a processor, and an adjustment mechanism. The saddle is connected to the frame. The crank arm is pivotally connected to the frame. The pedal is pivotally connected to the crank arm. The force measurement measures a force applied to the crank arm. The angle detector detects a crank arm angle. The processor is programmed to calculate a work value according to the force and the crank arm angle. The adjustment mechanism adjusts the height of the saddle according to the work value.

According to another embodiment, an exercise machine is provided. The exercise machine includes a frame, a saddle, at least one crank arm, at least one pedal, a force measurement, an angle detector, a processor, and an adjustment mechanism. The saddle is connected to the frame. The crank arm is pivotally connected to the frame. The pedal is pivotally connected to the crank arm. The force measurement measures a force applied to the crank arm. The angle detector detects a user's lower limb segment angle. The processor is programmed to calculate a work value according to the force and the user's lower limb angle. The adjustment mechanism adjusts the height of the saddle according to the work value.

According to yet another embodiment, an exercise machine includes a frame, at least one crank arm, at least one pedal, a force measurement, an angle detector, a processor, and a feedback mechanism. The crank arm is pivotally connected to the frame. The pedal is pivotally connected to the crank arm. The force measurement measures a force applied to the crank arm. The angle detector detects a crank arm angle. The processor is programmed to calculate a work value according to the force and the crank arm angle. The feedback mechanism returns the work value to a user.

DETAILED DESCRIPTION

A user's physical ability depends mainly on his cardiopulmonary function and muscle strength. The cardiopulmonary function can be obtained by measuring the user's heart rate and respiratory rate, but the muscle strength cannot be measured directly.

Therefore, an exercise machine including a feedback mechanism is provided. The exercise machine obtains a work value to indicate the work done by the muscles of the lower limbs of a user's according to any two of measurable values, and the feedback mechanism returns the work value to the user so that the user can keep exercising to reach a certain exercise intensity and duration. For example, the measurable value is a user's lower limb segment angle, an angular velocity of a user's lower limb segment, an angular acceleration of a user's lower limb segment, a crank arm angle, a force applied to a pedal, or a torque applied by the rotational motion of the crank arm driving by the pedal. The angular acceleration or angular velocity of the user's lower limb segments can be directly measured or converted from the user's lower limb segment angle.

Figure 1:
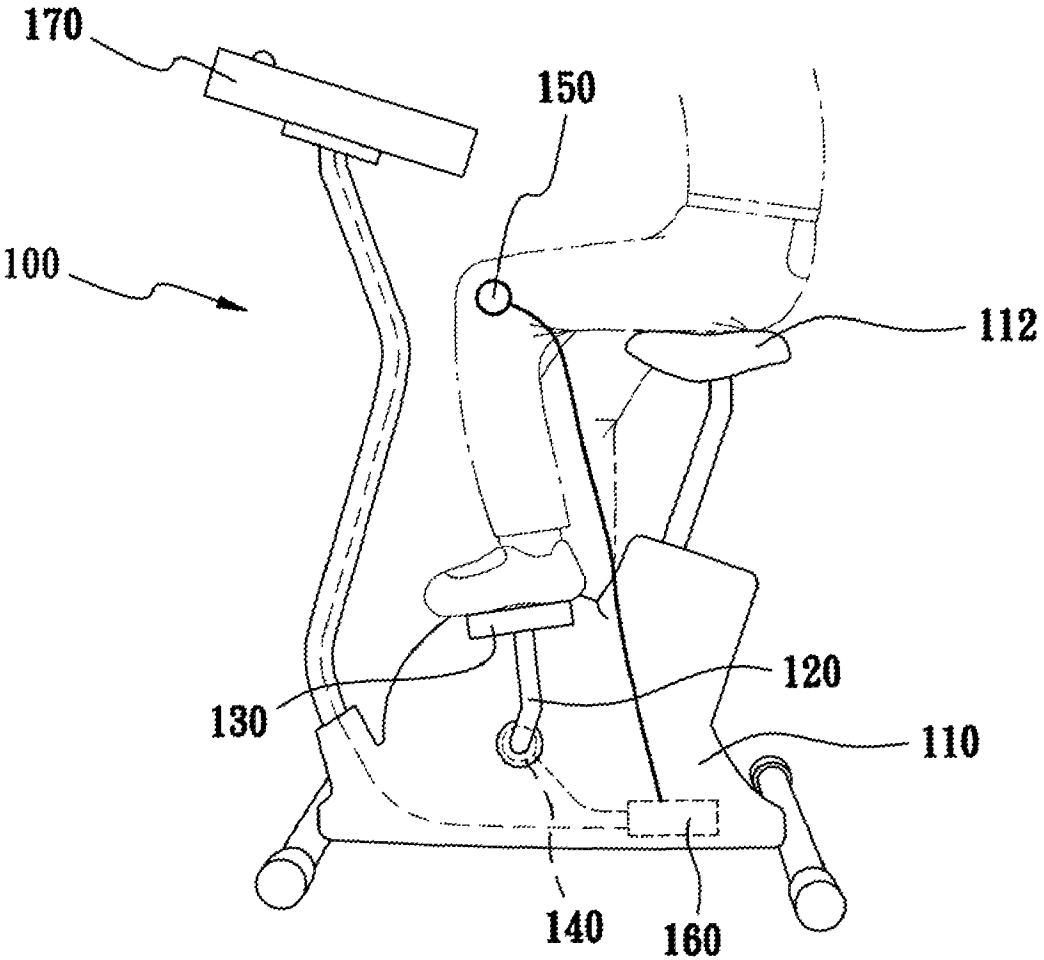
FIG. 1 is a side view of an exercise machine according to one embodiment of this invention.

FIG. 1 is a side view of an exercise machine according to one embodiment of this invention. An exercise machine 100 includes a frame 110, at least one crank arm 120, at least one pedal 130, a force measurement 140, an angle detector 150, a processor 160, and a feedback mechanism 170.

The frame 110 has an inner space and can stand on the ground. A saddle 112 is connected on the frame 110 for supporting the user to increase user comfort. The crank arm 120 is pivotally connected to the frame 110, and the pedal 130 is pivotally connected to the crank arm 120. Therefore, the user forces on the pedal 130 to rotate the crank arm 120.

The force measurement 140 is a torque measurement disposed on the pivotal point of the crank arm 120. The torque measurement measures torque applied by the rotational motion of the crank arm 120. Alternatively, the force measurement 140 is a load cell disposed on the pedal 130 to measure a force applied to the crank arm.

The angle detector 150 measures a user's lower limb angle, and the angle detector 150 is a goniometer or a gyroscope, for example. The user's lower limb segment angle means an angle between a lower limb segment and the horizontal line. The lower limb segment includes the thigh, the leg, and the foot segments. Therefore, the angle detector 150 is immobile relative to the user's lower limb segment for measuring the user's lower limb segment angle during user exercises, as shown in FIG. 1. The angle value of the user's lower limb segment also can be conversed to an angular velocity or an angular acceleration of the user's lower limb segment.

Alternatively, since the user's foot is put on the pedal 130 during exercise, the foot angle is equal to the pedal angle. The pedal angle means an angle between the pedal 130 and the horizontal line. Therefore, the angle detector 150 can be disposed on the pedal 130 to measure the pedal angle. In addition, the angle detector can be disposed on the crank arm 120 to measure a crank arm angle, which is the angle between the crank arm 120 and the horizontal line.

The foregoing force measurement 140 and the angle detector 150 are electrically connected to the processor 160. The processor 160 can be disposed on the inner space of the frame 110. The processor 160 is programmed to calculate a work value according to any two of the foregoing measurable values, such as the torque and the user's lower limb angle, the force and the user's lower limb angle, the torque and the crank arm angle, the force and the crank arm angle, or the torque and the force.

The feedback mechanism 170 returns the work value to a user. According to the embodiment, the feedback mechanism 170 is connected to the frame 110 and electrically connected to the processor 160. The feedback mechanism 170 can be a display, a loudspeaker, a derailleur mechanism, a saddle adjustment mechanism, or a flywheel motor. For example, the work value calculated by the processor 160 can be shown on the display to the user.

Accordingly, the processor 160 of the exercise machine 100 calculates a work value according any two of measurable values detecting by a load cell, a torque measurement and an angle detector. Then, the feedback mechanism 170 of the exercise machine 100 returns the work value to the user. Furthermore, all measurable values are measured continuously while the user uses the exercise machine. Therefore, the processor 160 calculates the work value continuously, so the feedback mechanism 170 can return the work value to the user immediately.

Figure 2:
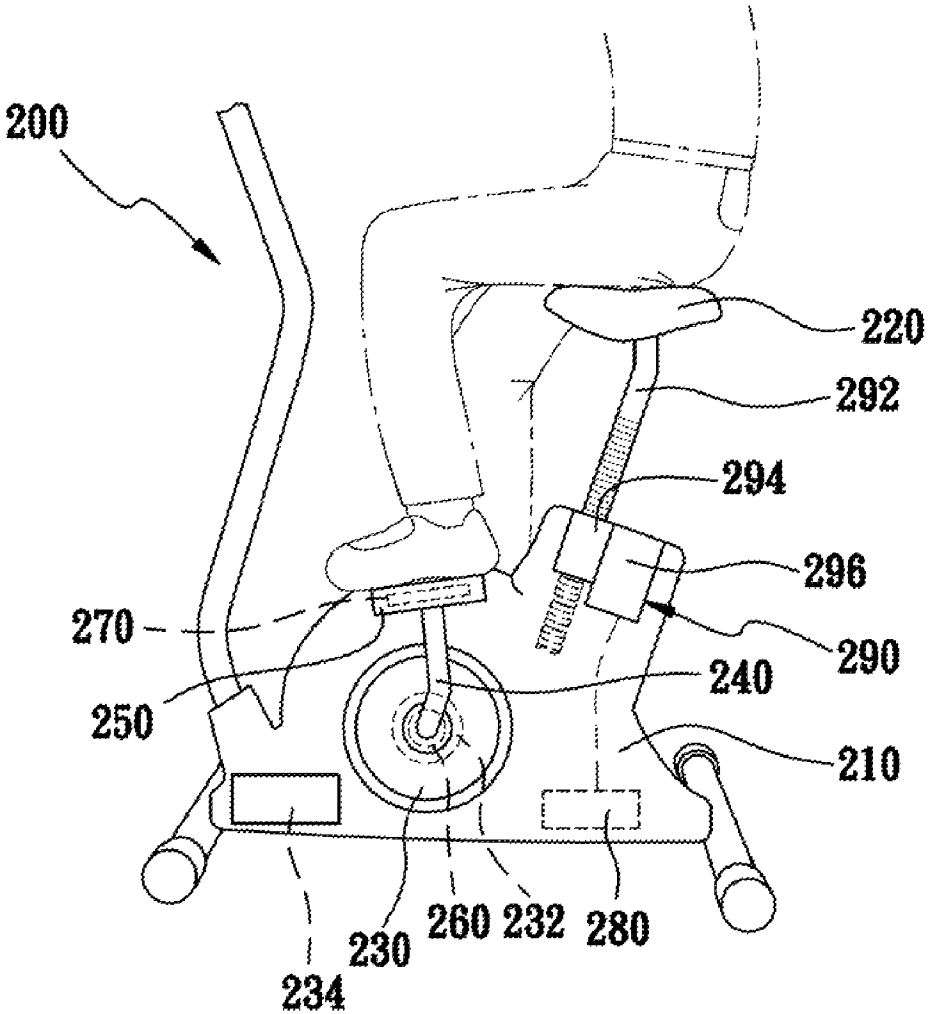
FIG. 2 is a side view of an exercise machine according to another embodiment of this invention.

FIG. 2 is a side view of an exercise machine 200 according to another embodiment of this invention. In order to reduce a user's discomfort and force applied on the pedal while the user rides an exercise machine, the exercise machine including a saddle adjustment mechanism and a flywheel motor is provided. The exercise machine 200 includes a frame 210, a saddle 220, a flywheel 230, at least one crank arm 240, at least one pedal 250, a torque measurement 260, an angle detector 270, a processor 280, and a saddle adjustment mechanism 290.

The detail structures of the frame 210, the torque measurement 260, and the processor 280 are substantially the same as those of the exercise machine 100 of the foregoing embodiment. The difference between the exercise machine 100 and 200 is as follows.

The saddle 220 is connected to the frame 210. The flywheel 230 is pivotally connected to the frame 210. The crank arm 240 is pivotally connected to axis center of the flywheel 230, and the pedal 250 is pivotally connected to the crank arm 240. The angle detector 270 is disposed on the pedal 250 to measure the pedal angle.

The flywheel 230 can have a certain weight for applying resistance to the pedal 250. Therefore, when a user uses the exercise machine, the user needs to apply more force on the pedal 250 for driving the flywheel 230 to rotate. In addition, the exercise machine 200 also includes a flywheel motor 232 for driving the flywheel 230 and a power supply 234 for providing electric power to the flywheel motor 232 according to the work value calculated by the processor 280. In detail, the power supply 234 can convert a user's kinetic energy to an electric energy when user uses the exercise machine and then provide the electric energy to the flywheel motor according the work value.

The saddle adjustment mechanism 290 includes a tooth bar 292, a gearbox 294, and a motor 296. The saddle 220 is connected to one end of the tooth bar 292, and the tooth bar 292 is through the gearbox 294. The motor 296 is electrically connected to the processor 280 and the gearbox 294. Therefore, the gearbox 294 translates the output of the motor 296 to raise or lower the saddle 220 through the tooth bar 292 according to the work value.

Figure 3:
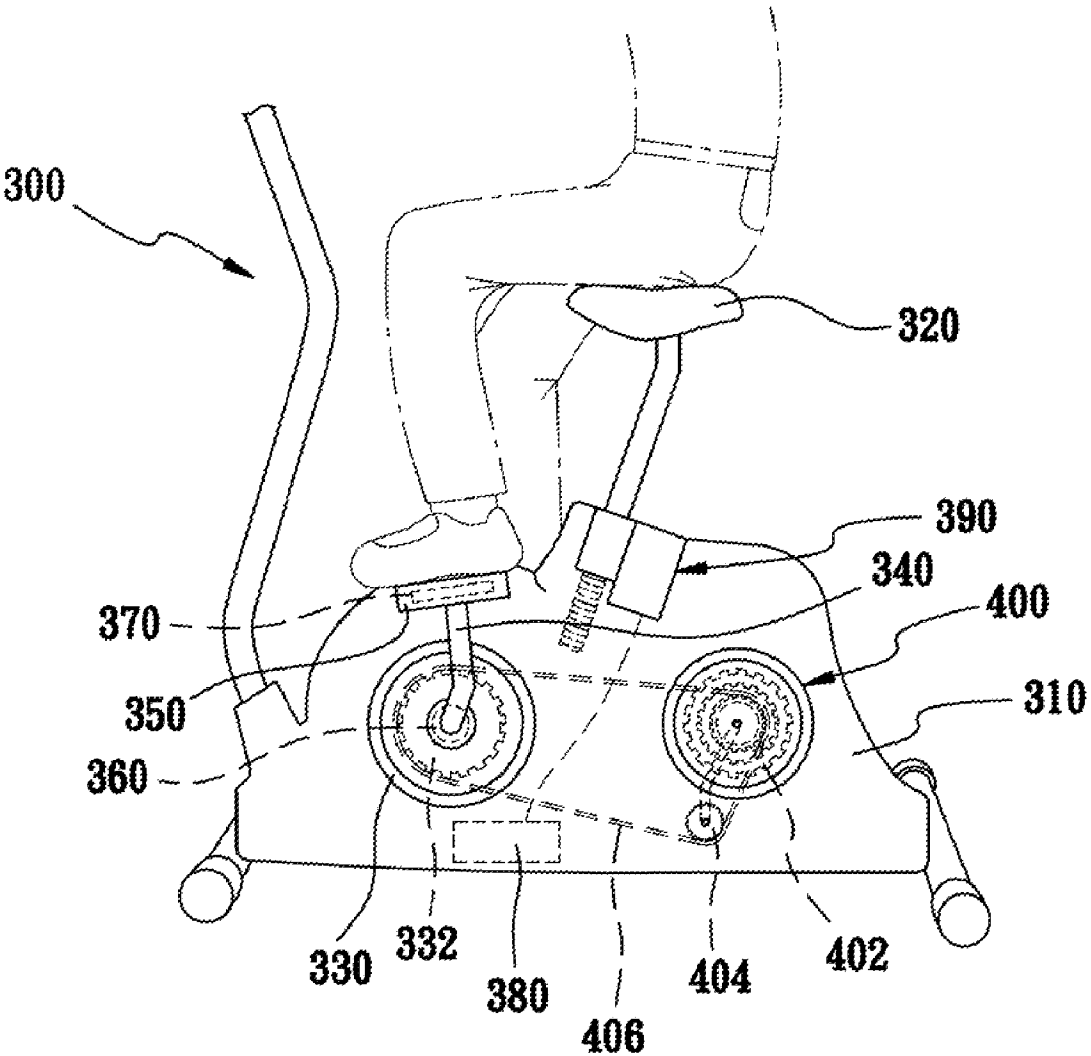
FIG. 3 is a side view of an exercise machine according to yet another embodiment of this invention.

FIG. 3 is a side view of an exercise machine according to yet another embodiment of this invention. In this embodiment, the exercise machine includes a saddle adjustment mechanism and a derailleur mechanism for reducing a user's discomfort and force applied on the pedal while the user rides the exercise machine. The exercise machine 300 includes a frame 310, a saddle 320, a wheel 330, at least one crank arm 340, at least one pedal 350, a torque measurement 360, an angle detector 370, a processor 380, a saddle adjustment mechanism 390, and a derailleur mechanism 400.

The detail structures of the frame 310, the saddle 320, the crank arm 340, the pedal 350, the torque measurement 360, the angle detector 370, the processor 380, and the saddle adjustment mechanism 390 are substantially the same as those of the exercise machine 200 of the foregoing embodiment. The difference between the exercise machine 200 and 300 is as follows.

The wheel 330 is pivotally connected to the frame 310 and coaxial with a gear 332. The derailleur mechanism 400 adjusts the rotation rate of the wheel 330 according to the work value. The derailleur mechanism 400 includes a gear set 402, a derailleur 404, and a drive chain 406. The gear set 402 includes more than two gears with different radius, and all gears are coaxial pivotally connected to the frame 310. The chain 406 connects the gear set 402 to gear 332 coaxial with the wheel 330, and the derailleur 404.

When the user forces on the pedal 350 to drive the wheel 330 rotating, the active chain 406 drives the gear set 402. The derailleur 404 adjusts the active chain 406 to the proper gear size to reduce the force applied by the user to the pedal 350.

Figure 4:
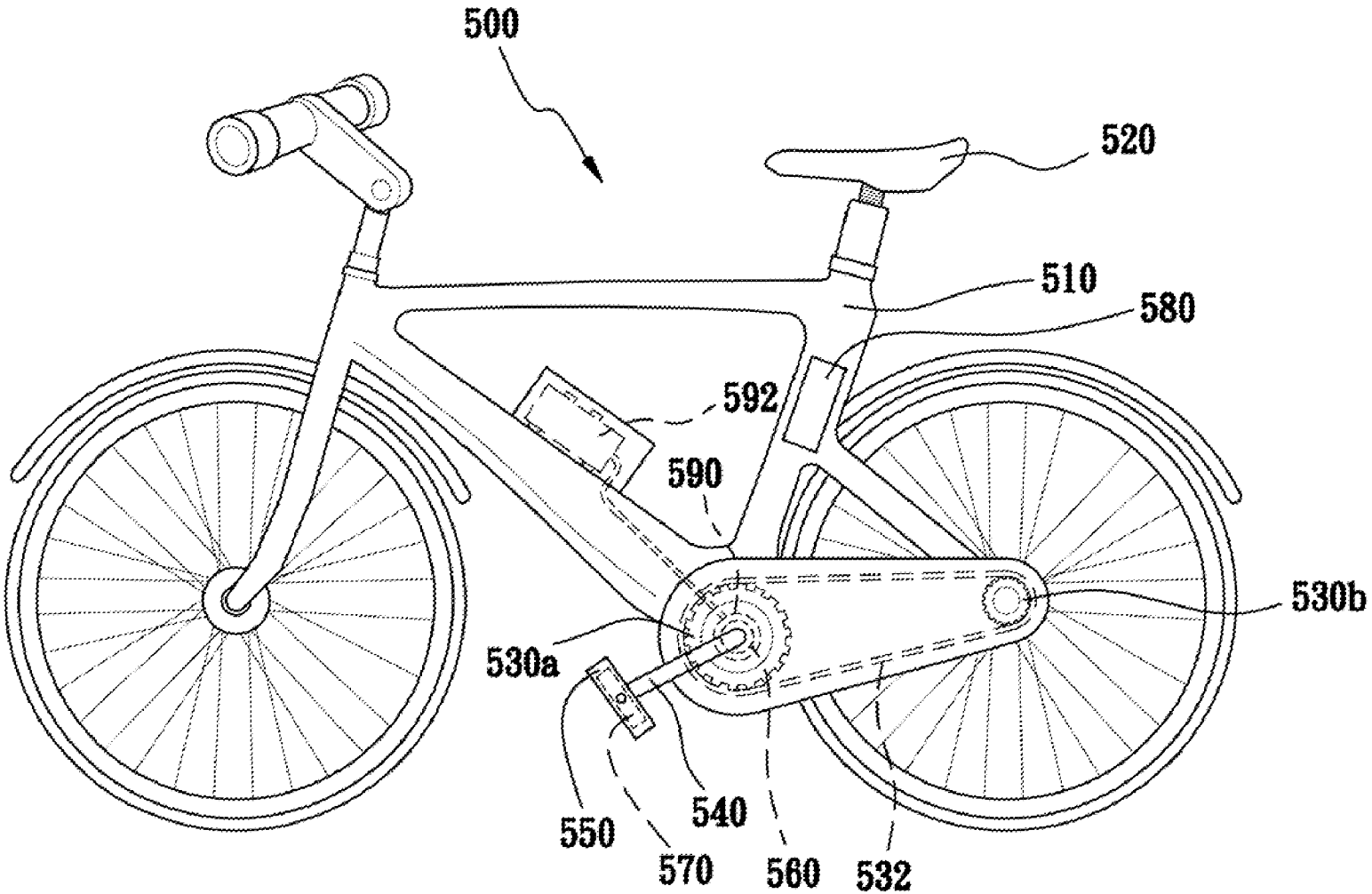
FIG. 4 is a side view of an exercise machine according to still another embodiment of this invention.

The forgoing exercise machine and the feedback mechanism can be to applied to a bicycle. FIG. 4 is a perspective view of an exercise machine according to still another embodiment of this invention. The exercise machine 500 includes a frame 510, a saddle 520, a front gear 530*a*, a rear gear 530*b*, at least one crank arm 540, at least one pedal 550, a torque measurement 560, an angle detector 570, a processor 580, and a gear motor 590. The detail structures of the torque measurement 560, the angle detector 570, and the processor 580 are substantially the same as those of the exercise machine 200 of the foregoing embodiment.

The frame 510, the saddle 520, two gears 530*a*, 530*b*, the crank arm 540, and the pedal 550 are assembled to form a conventional bicycle. The crank arm 540 is pivotally connected to the front gear 530*a*, and the pedal 550 is pivotally connected to the crank arm 540. When user forces on the pedal to drive the front gear 530*a*, then the gear 530*b* is driven by an active chain 532.

The gear motor 590 can drive the front gear 530*a* according to the work value calculated by the processor 580. The electric power of the gear motor 590 is saved in a power supply 592. In detail, the power supply 592 can convert a user's kinetic energy to an electric energy when user rides the exercise machine 500, and then provide the electric energy to the gear motor 590 according the work value.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An exercise machine comprising:

a frame;

a saddle connected to the frame;

at least one crank arm pivotally connected to the frame;

at least one pedal pivotally connected to the crank arm;

a force measuring device for measuring a force applied to the crank arm;

an angle detector for detecting a crank arm angle;

a processor programmed to calculate a work value according to the force and the crank arm angle; and an adjustment mechanism for automatically adjusting the height of the saddle according to the work value.

2. The exercise machine of claim 1, wherein the adjustment mechanism comprising:

a motor;

a tooth bar, wherein the saddle is connected to one end of the tooth bar; and a gearbox for translating the output of the motor to raise or lower the saddle through the tooth bar.

3. The exercise machine of claim 1, further comprising:

a flywheel for applying resistance to the pedal; and a motor for driving the flywheel according to the work value; and a power supply for providing electric power to the motor according to the work value.

4. The exercise machine of claim 1, wherein the angle detector is a goniometer or a gyroscope.

5. The exercise machine of claim 1, wherein the force measurement is a torque meter for measuring torque applied by the rotational motion of the crank arm.

6. The exercise machine of claim 1, wherein the force measurement is a load cell.

* * * * *